US005586661A

United States Patent [19]

Maki

[11] Patent Number: 5,586,661

[45] Date of Patent: Dec. 24, 1996

[54] DAM MEMBER FOR A SCREEN DECK

[75] Inventor: Roger M. Maki, Hibbing, Minn.

[73] Assignee: Illinois Tool Works Inc., Glenview, Ill.

[21] Appl. No.: 357,911

[22] Filed: Dec. 15, 1994

[51] Int. Cl.[6] ..... B07B 1/49

[52] U.S. Cl. ..... 209/397; 209/399; 209/414

[58] Field of Search ..... 209/397, 398, 209/399, 352, 263–264, 408, 412, 413, 414

[56] References Cited

U.S. PATENT DOCUMENTS

| | | | |
|---|---|---|---|
| 3,795,311 | 3/1974 | Martin | 209/399 X |
| 3,900,628 | 8/1975 | Stewart | 209/399 X |
| 4,265,742 | 5/1981 | Bucker et al. | 209/399 |
| 4,661,245 | 4/1987 | Rutherford et al. | 209/399 |
| 4,762,610 | 8/1988 | Freissle | 209/397 |
| 4,882,044 | 11/1989 | Freissle | 209/319 |
| 4,909,929 | 3/1990 | Tabor | 209/412 X |
| 5,085,324 | 2/1992 | Dehlen | 209/399 |
| 5,112,475 | 5/1992 | Henry, Jr. | 209/399 |
| 5,213,217 | 5/1993 | Galton et al. | 209/399 |
| 5,361,911 | 11/1994 | Waites, Sr. et al. | 209/399 |
| 5,462,175 | 10/1995 | Bokor | 209/399 |

FOREIGN PATENT DOCUMENTS

| | | | |
|---|---|---|---|
| 8302075 | 6/1983 | European Pat. Off. | 209/412 |
| 567361 | 10/1993 | European Pat. Off. | 209/399 |
| 1480894 | 5/1989 | U.S.S.R. | 209/399 |

*Primary Examiner*—Boris Milef

*Attorney, Agent, or Firm*—Mark W. Croll; Thomas W. Buckman; John P. O'Brien

[57] ABSTRACT

A dam for use with a screen deck for screening materials such as coal, sand, limestone, crushed stone and various ores where the dam regulates the flow of material across the screen deck, can be releasably retained to the screen deck in various positions about the screen deck and readily can be removed and repositioned about the screen deck or replaced with another dam member of a different size, configuration or both to accommodate various applications.

9 Claims, 1 Drawing Sheet

DAM MEMBER FOR A SCREEN DECK

FIELD OF THE INVENTION

The present invention relates generally to screen decks for screening materials such as coal, sand, gravel, limestone, crushed stone and various ores and more particularly to a dam member for a screen deck which regulates the flow of material across the surface of the screen deck, can be releasably retained to the screen deck in various positions about the screen deck and readily can be removed and repositioned on the screen deck, substantially without the use of any fasteners, or replaced with another dam member of a different size, configuration or both to accommodate various applications.

BACKGROUND OF THE INVENTION

Screen decks typically are utilized to screen materials such as coal, sand, gravel, limestone, crushed stone, ores or the like. Existing screen decks include a screening surface having a plurality of apertures therethrough of a size selected for the particular material being screened.

The material typically is provided in bulk onto a top surface of the screen deck where smaller particles of the material filter through the apertures and are collected beneath the screen. Larger particles of material greater than the size of the apertures remain above the top surface and either run off or are removed from the screen for further processing.

The screen deck must be formed from a material strong enough to support the weight of the material being screened without deformation. Additionally, since the material to be screened frequently includes water and/or chemicals, the material forming the screen deck must be substantially impervious to rust and corrosion.

To provide the desired strength and corrosion resistance, screen decks typically are formed from metal and are coated with another material, such as plastic or the like. Screen decks can be provided as a unitary surface or as modular systems with a plurality of interchangeable panels.

In order to provide a constant flow of material to be screened through the screen apertures and to provide a flow of large particles of material across the screen deck, the screen deck is typically positioned at a predetermined slope or incline. The large particles of material can then flow across the top surface of the screen deck for collection and further processing while the smaller particles of material fall through the apertures and are collected beneath the screen deck.

In some applications, the flow of material to be screened flows too fast across the surface of the screen deck which inhibits filtering of the smaller particles of material therethrough. To regulate the flow of material across the surface of the screen deck, dam members are positioned across the surface of the screen deck.

Existing dam members, however, are permanently secured to the unitary deck surface or individual deck panels in a modular system. Accordingly, in order to modify the deck surface to include, remove or substitute a dam member, the entire deck surface or affected panels must be removed and replaced with a different deck surface or panels as desired. Such modification is expensive, not only due to the labor involved in the modification but also in stocking a variety of unitary deck surfaces or deck panels having attached dam members of different sizes and configurations.

It therefore would be desirable to provide a dam member for use with a screen deck which is releasably secured to a portion of the screen deck and readily can be removed and replaced as desired.

SUMMARY OF THE INVENTION

The present invention provides a dam member for use with a screen deck used for screening materials such as coal, sand, gravel, limestone, crushed stone, ores or the like. The screen deck is preferably formed from a plurality of readily interchangeable panels, each panel having a plurality of apertures of a predetermined size therethrough. Once assembled into a desired array, the panels form a substantially planar screening surface through which smaller particles of the material are screened or filtered.

The panels are secured in position on a supporting frame in a releasable manner in order to readily replace a worn panel or to replace all of the panels with panels having different size apertures for screening of a different material. The screen deck is preferably positioned with a predetermined slope or incline so that the material to be screened flows across the surface of the screen deck for more efficient operation.

The dam member of the invention is releasably secured between panels of the screen deck to regulate and direct the flow of material across the surface of the screen deck as desired. Preferably, the dam members are positioned across the surface of the sloped screen deck substantially perpendicular to the direction of flow of the material, but can vary.

The dam members provide a more even distribution of material across the surface of the screen deck to prevent the majority of the material from flowing across the screen deck without being screened and to reduce the accumulation of smaller particles of material at the bottom of the screen deck. Accordingly, the material can be screened at a much faster rate and collection of the smaller particles of screened material beneath the screen deck is more evenly distributed.

Other features and advantages of the present invention will become readily apparent from the following detailed description, the accompanying drawings and the appended claims.

DESCRIPTION OF THE PREFERRED EMBODIMENT

Figure 1:
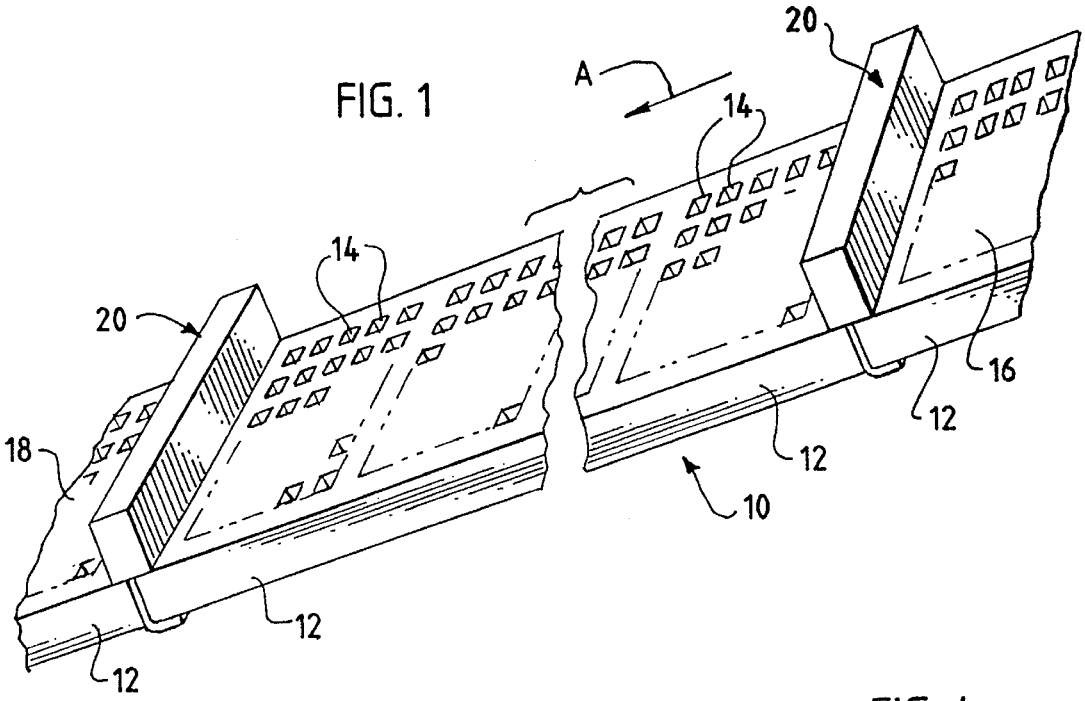
FIG. 1 is a perspective view of a portion of a modular screen deck inclined at a predetermined slope and illustrating dam members of the invention releasably secured thereto.
Figure 2:
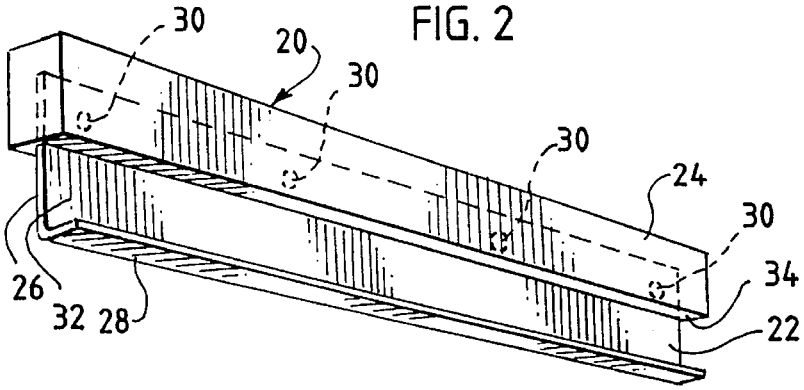
FIG. 2 is a perspective view of a dam member of the invention removed from the screen deck.
Figure 4:
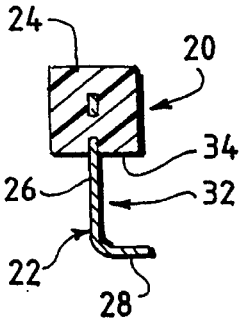
FIG. 4 is a lateral cross-sectional view of the dam member of the invention taken along line 4—4 of FIG. 3 and in the direction indicated.
Figure 3:
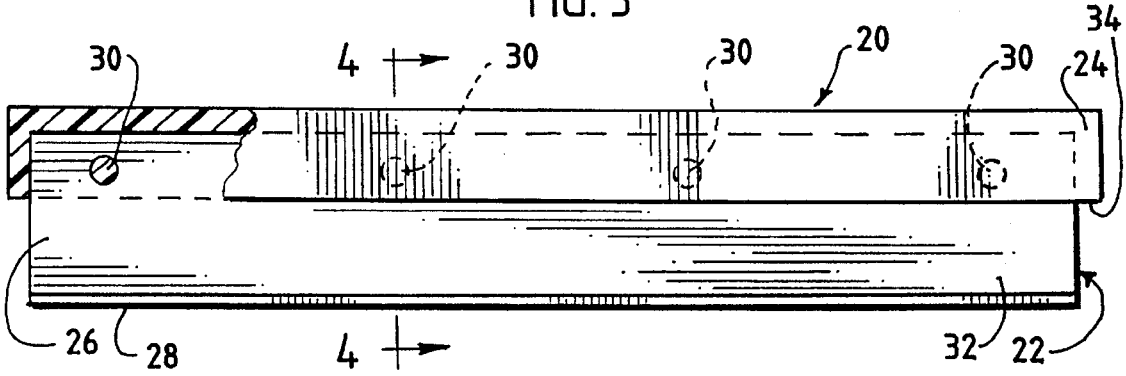
FIG. 3 is a front elevational view, in partial section, of the dam member illustrated in FIG. 2.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

For ease of description, the apparatus of this invention is described in the normal, upright, operating position and terms such as upper, lower, horizontal, etc., are utilized with reference to this position. It will be understood, however, that the apparatus of this invention may be manufactured, stored, transported and sold in an orientation other than the position described.

Referring to FIG. 1, a modular screen deck is designated generally with the reference numeral 10. The screen deck 10 is formed from an array of individual panels 12, each panel 12 having a plurality of apertures 14 extending therethrough.

The panels 12 which make up the screen deck 10 preferably are interconnected and secured to a frame member by releasable fasteners. For ease of description, the frame member and fasteners are not illustrated. It is to be understood,however, that the panels 12 can be interconnected and supported in any desired way and the fasteners and frame member may be omitted if desired.

In order to provide a flow of material to be screened across the top surface of the panels 12, the panels 12 are preferably positioned with a predetermined slope or incline as illustrated in FIG. 1. Although only one width of panels 12 is illustrated, it is to be understood that the panels 12 can be positioned in a number of different configurations to provide a screen deck 10 having a variety of widths and lengths as desired.

Briefly, in operation, material to be screened is loaded or dumped onto the upper end 16 of the screen deck 10. Due to the slope of the screen deck 10, which can vary, the material flows in the direction of arrow "A" toward the opposite lower end 18 of the screen deck 10.

As the material flows, particles of the material which are smaller than the selected size of the apertures 14 flow through the apertures 14 and are collected beneath the screen deck 10 for further processing. At the same time, particles of the material which are larger than the selected size of the apertures 14 flow across the surface of the screen deck 10 to the lower end 18 and run off the screen deck 10 for collection and further processing.

Each panel 12 preferably includes a core formed of metal, such as steel, and is coated with a plastic, such as thermal setting urethane or the like. It is to be understood, however, that the panels 12 can be formed from any desired material so long as they provide sufficient strength to support the weight of the material to be screened without deformation and do not rust or corrode. The screen deck is formed from a material having a substantially high resistance to at least one of abrasion, wear, rust and corrosion.

Although the panels 12 are illustrated as rectangular in shape, the particular shape of the panels 12 can vary. Additionally, the thickness of each panel 12 is selected for cooperative engagement with the dam member of the invention as described below.

FIGS. 1–4 illustrate a dam member 20 of the present invention. The dam member 20 is formed from an elongate bracket member 22 and an elongate wall member 24 which is slightly longer than the bracket member 22.

The bracket member 22 preferably is formed from metal, such as steel, stainless steel or the like, with a substantially L-shaped cross-sectional configuration and is defined by a first leg 26 and a second leg 28. The wall member 24 is formed with a substantially square or rectangular cross-sectional configuration from plastic material, such as thermal setting urethane or the like. The dam member is formed from a material having a substantially high resistance to at least one of abrasion, wear, rust and corrosion.

To assemble the bracket member 22 to the wall member 24, the wall member 24 preferably is molded over a top portion of the first leg 26 opposite the second leg 28. In order to assist in securing the wall member 24 to the bracket member 22, the first leg 26 of the bracket member 22 includes a plurality of apertures 30 through which the urethane material of the wall member 24 flows during molding. The bracket member 22 being secured to the wall member 24 by at least one of an adhesive, thermal bonding, molding, welding or fasteners.

After molding, a channel 32 is formed between the second leg 28 of the bracket member 22 and a bottom side 34 of the wall member 24 facing the second leg 28. The channel 32 is selected to have a width substantially corresponding to the thickness of each panel 12 so that the dam member 20 can be secured thereto as described below.

In use, prior to attaching the panels 12 together to form the screen deck 10, the channel 32 of a dam member 20 is positioned about a side of a panel 12 as FIG. 1 illustrates. Once the panels 12 are secured together, the dam member 20 is held in position between opposing panels 12. If desired, a plurality of dam members 20 can be positioned about the surface of the screen deck 10 between adjacent panels 12.

Accordingly, the dam members 20 readily can be removed and repositioned as needed on the surface of the screen deck 10 or to provide a dam member 20 having a different size, configuration or both. Due to the channel 32, the dam members 20 can be rapidly removed and reassembled without having to disassemble the entire screen deck 10 and substantially without the use of any fasteners.

Additionally, the removable dam members 20 enable reduction in the inventory of panels 12 since it is only necessary to store panels 12 based on the size and/or position of the apertures 14 and not whether a panel 12 includes a dam member.

From the foregoing, it will be observed that numerous modifications and variations can be effected without departing from the true spirit and scope of the novel concept of the present invention. It will be understood that no limitation with respect to the specific embodiment is intended or should be inferred. The disclosure is intended to cover, by the appended claims, all such modifications as fall within the scope of the claims.

What is claimed is:

1. A one-piece dam member for a screen deck having at least two adjacent panels, each panel having a top surface, a bottom surface and an adjoining side surface, said top surface being coplanar the dam member comprising:

a wall member formed from a material having a substantially high resistance to abrasion mountable on the top surface of at least one of the adjacent panels; and a bracket member having an L-shape cross-sectional configuration defined by a first leg and a second leg, the first leg having an upper portion opposite the second leg, and a lower portion, the upper portion of the first leg secured to the wall member to form a one-piece dam member, wherein the lower portion of the first leg of the bracket member is retained in releasable engagement between the adjoining side surfaces of the adjacent panels, and the second leg of the bracket member extends along the bottom most surface of one of the panels, and wherein the dam member is readily placed in desired positions about the screen deck.

2. A dam member as defined in claim 1 wherein the wall member is formed from a thermal setting urethane.

3. A dam member as defined in claim 2, wherein the upper portion of the first leg includes apertures, and the wall member is secured to the first leg by molding the wall member to the first leg wherein the wall member extends through the apertures in the upper portion of the first leg during molding.

4. A dam member as defined in claim 1 wherein the adjoining side surface of each panel defines a panel thickness between the top and bottom surfaces of the panel, the dam member further comprising a channel formed between the wall member and the second leg of the bracket member, the channel having a width corresponding substantially to the panel thickness.

5. A modular screen deck for screening materials including coal, sand, gravel, limestone, crushed stone and ores, the modular screen deck comprising:

a plurality of adjacent screening panels forming a substantially continuous planar screening surface, each panel having a bottom surface and an adjoining side surface, and each panel including a plurality of apertures therethrough selected and positioned for screening a desired material; and a one-piece dam member having a wall member from a material having a substantially high resistance to abrasion mountable on the top surface of at least one of the panels, said dam member having a bracket member with an L-shape cross-sectional configuration defined by a first leg and a second leg, said first leg having an upper portion opposite said second leg and a lower portion, the upper portion of said first leg secured to said wall member to form a one-piece dam member, wherein said lower portion of said first leg of said bracket member is retained in releasable engagement between the adjoining side surfaces of the adjacent panels, and said second leg of said bracket member extends along the bottom most surface of one of the panels, wherein said dam member is releasably secured at a desired position about said planar screening surface formed by said panels to regulate flow of material across said planar screening surface.

6. A modular screen deck as defined in claim 5 wherein said dam member and said screening panels are formed from a material having a substantially high resistance to at least one of abrasion, wear, rust and corrosion.

7. A modular screen deck as defined in claim 6 wherein said wall member is formed from a thermal setting urethane and said screening panels are formed from metal and coated with a thermal setting urethane to a desired thickness.

8. A modular screen deck as defined in claim 5 wherein said upper portion of said first leg includes apertures, and said wall member is secured to said first leg by molding said wall member to said first leg wherein said wall member extends through said apertures in said upper portion of said first leg during molding.

9. A modular screen deck as defined in claim 5 wherein the adjoining side surface of each panel defines a panel thickness between the top and bottom surfaces of said panel, said dam member further comprising a channel formed between said wall member and said second leg of said bracket member, said channel having a width corresponding substantially to the panel thickness.

* * * * *